US005150556A

United States Patent [19]

Yamada et al.

[11] Patent Number: 5,150,556

[45] Date of Patent: Sep. 29, 1992

[54] CHORD TRUSS ROOF STRUCTURE

[75] Inventors: Toshiyuki Yamada; Yoshihiro Takahama; Kazushige Kurihara; Hajime Nakajima, all of Tokyo, Japan

[73] Assignee: Shimizu Construction Co., Tokyo, Japan

[21] Appl. No.: 587,679

[22] Filed: Sep. 25, 1990

[30] Foreign Application Priority Data

Oct. 6, 1989 [JP] Japan ..... 1-261622
Oct. 6, 1989 [JP] Japan ..... 1-261623

[51] Int. Cl.[5] ..... E04B 1/32; E04B 7/08; E04C 3/38

[52] U.S. Cl. ..... 52/639; 52/73; 52/80

[58] Field of Search ..... 52/73, 80–82, 52/639, 646, 648, 639

[56] References Cited

U.S. PATENT DOCUMENTS 1,776,656 8/1930 Wasilkowski ..... 52/73
1,825,800 10/1931 Houseman ..... 52/80
2,670,818 3/1954 Hacker ..... 52/82
3,139,957 7/1964 Fuller ..... 52/80
3,153,302 10/1964 Wheeler ..... 52/73
3,270,470 9/1966 Wilkie et al. ..... 52/82
3,377,637 4/1968 Zamorano ..... 52/86
3,410,039 11/1968 Brezina ..... 52/80

*Primary Examiner*—James L. Ridgill, Jr.
*Attorney, Agent, or Firm*—Kane, Dalsimer, Sullivan, Kurucz, Levy, Eisele and Richard

[57] ABSTRACT

A chord truss roof includes a ring-girder, cross beams arranged radially around the ring-girder, chord members stretched between the respective cross beams and the ring-girder. The roof supports itself by tensioning the chord members. The ring-girder has an upper compression ring, a lower tension ring, and plural struts connecting the two rings. The chord members arranged opposite one another with both end portions of the tension ring interposed therebetween are connected to the corresponding end portions of the tension ring, and are joined to one another via connection members which are disposed between both end portions of the tension ring. Further, each strut is provided along a line which bisects the angle made by a corresponding chord member and the plane defined by the tension ring.

4 Claims, 5 Drawing Sheets

CHORD TRUSS ROOF STRUCTURE

BACKGROUND OF THE INVENTION

The present invention relates to the structure of a chord truss roof which is adapted to be stressed in a predetermined manner by tensioning its cable or chord members to support itself with no strut provided in the center.

As one of the construction types of long span structure roofs, there is a chord truss roof structure.

A roof of the conventional chord truss roof has an annular ring-girder figures. The ring girder is composed of a compression ring and a tension ring which are respectively located at upper and lower positions in the ring-girder and joined to each other by struts. Installed on the compression ring is a roof light window. Cross beams are radially arranged around the ring-girder and respectively joined to the outer periphery thereof. Plural beams and braces are provided between and joined to adjacent cross beams to form a trussed roof. Furthermore, cable or chord members are stretched between outer ends of the respective cross beams and the tension ring at the bottom of the ring-girder. The chord members are tensioned to stress the roof structure. More particularly, the tensions acting on the respective chord members cause forces for pushing up the crossbeams 4; cross beams; the forces are transmitted through the struts to the cross beams, so that the roof can support itself. Side wall sections are separately constructed, and the roof is laid on the side wall sections with its outer ends supported by upper end portions of the side wall sections. Incidentally, seat portions are provided inside the side wall sections.

The building having the roof 8 of this structure is constructed, for instance, in the procedure shown in FIGS. 7 to 9.

First of all, as shown in FIG. 7, steel frames of the side wall sections 5 of the building are erected with cranes, and a working platform 11 for the ring-girder is assembled in approximately the center of the building. Then, the ring-girder 1 is assembled with the support by the working platform 11 as shown in FIG. 8. The ring-girder 1 is, for instance, of a circular shape as viewed from above, and the tension ring 3 is formed at the bottom of the ring-girder.

Subsequently, a skeleton or structural body work is executed on the steel frames with reinforced concrete. The cross beams 4 are laid one after another with the cranes between the upper end portions of the side wall sections 5 and the ring-girder to be assembled in an arcuate shape as viewed from the side and in a circular shape as viewed from above. The beams, braces and so forth are installed to form the chord truss roof.

After the above work, the chord members 6 are installed between the respective outer ends 4*a* of the cross beams 4 and the tension ring 3 at the bottom of the ring-girder 1, as shown in FIG. 9. Subsequently, the chord members 6 are tensioned to exert a required stress on the trussed roof thus assembled, so that the trussed roof can support itself. The chord truss roof 8 is thus completed, and the working platform 11 is removed.

In addition, after the tensioning, roofing materials, etc. are installed by adhesion over the chord truss roof 8, and finish works, such as a waterproofing work and so on, are performed to complete the whole work.

However, in the chord truss roof 8 of the above structure, the chord members 6 on both sides of the ring-girder 1 are continuous so that each extends across the ring-girder 1 from the outer end 4*a* of one cross beam 4 to the outer end 4*a* of an opposite cross beam 4. In the case of the chord truss roof 8 of a large size therefore, each chord member 6 also becomes long accordingly and when tensioning the chord member 6, a jack which is a means for tensioning has to have a sufficiently long stroke. For this reason, it is necessary when tensioning the chord members 6 to provide jacks of large sizes. Improvement of the structure in this respect has been desired. Additionally, since the tension ring 3 at the bottom of the ring-girder 1 is subjected to forces for inwardly thrusting the same due to the tensioning of the chord members 6, the tension ring 3 needs reinforcing.

SUMMARY OF THE INVENTION

It is an object of the invention to provide a chord truss roof structure which can readily be stressed with jacks of relatively short stroke.

It is another object of the invention to provide a chord truss roof which is reinforced in its tension ring while involving less increase in weight.

Still another object of the invention is to provide a chord truss roof structure wherein tension applied to each chord member thereof is effectively transmitted to a corresponding cross beam so that the tension to be applied to the chord member per se can be reduced.

For the above ends, according to one aspect of the invention, there is provided a chord truss roof structure which comprises side wall sections;

a ring-girder having a tension ring disposed approximately at the center of the chord truss roof, a compression ring located above the tension ring and in parallel thereto, and struts connected between the compression ring and the tension ring;

cross beams radially erected between the compression ring and said side wall sections, each cross beam having one side portion and another side portion, each one side portion being coupled to the compression ring and each other side portion being coupled to the side wall sections;

chord members, each having a first end and a second end, said chord members extending under tension, with said first ends being connected to said tension ring and said second end being connected to said another side portions, said first ends defining a plane through said tension ring;

connection members each connection member being connected between two end portions, said connection members being disposed in said plane, so that the chord members and the connection members therebetween form a unitary structure;

whereby the chord truss roof structure can be erected without a support base for supporting thereof.

Preferably, the cross beams are trussed girders, each of said connection members may be an H-beam and the like.

Moreover, the struts may bisect the angle between the chord member and the connection member in side view.

The shape of the ring-girder may preferably be, for example, circle, elliptical and the like in top view.

With the above structure of the chord truss roof, the length of each chord member can be reduced to less than half as compared with the continuous chord member which has been used hitherto. Accordingly, the required stroke of a jack for tensioning each chord member may be short, and a large jack is unnecessary. Further, by respectively disposing the chord members on both sides of the ring-girder or as a result of the chord members being divided by the ring-girder it becomes easy to apply stress to the roof in a balanced manner by means of the chord members. Furthermore, as the ends of the chord members on the ring-girder side are connected to one another by the connection members, the ring-girder so to speak, in a state of being connected to each other by the connection members. Therefore, the stress applied to the chord members is smoothly and effectively transmitted to the ring-girder, and it becomes possible to rationally design the roof.

According to another aspect of the invention, there is provided a chord truss roof comprising a ring-girder which has compression and tension rings respectively located at upper and lower positions of the ring-girder and joined to each other by struts, cross beams radially provided around the compression ring of the ring-girder and chord members each stretched under predetermined tension between the cross beams and the tension ring, wherein each strut of the ring-girder is provided to stand substantially along a segment of a line which bisects an angle made by a corresponding chord member and a plane in which the tension ring is provided.

Herein, the plane in which the tension ring is provided means a plane including an imaginary ring which is defined by connecting joints of the respective chord members and the tension ring.

With the roof structure according to the second aspect of the invention, as each strut of the ring-girder is provided along the line segment which bisects the angle made by a corresponding chord member and the plane in which the tension ring is provided, the direction of a resultant force from the tensions respectively acting on the tension ring and the chord member coincides with the direction in which the strut is provided. As a result, according to the chord truss roof structure of this aspect, the tension applied to each chord member is effectively transmitted as a force for pushing up the roof to a corresponding cross beam. Accordingly, the tension to be applied to each chord member for allowing the roof to support itself can be lessened.

Moreover, as the direction of the resultant force from the tensions respectively acting on the tension ring and each chord member coincides with the direction in which a corresponding strut is provided, the load on the strut acts in the axial direction thereof. Accordingly, no lateral load due to the tension applied to the chord member acts on the strut, and the load on the strut can be reduced.

BRIEF DESCRIPTION OF THE DRAWINGS

FIG. 3A shows a partial plain view of the chord truss roof structure of FIGS. 1–3.

FIG. 5 is a sectional side view of the structure and FIG. 6 is a schematic perspective view thereof as viewed from above.

DETAILED DESCRIPTION OF THE PREFERRED EMBODIMENTS

Figure 1:
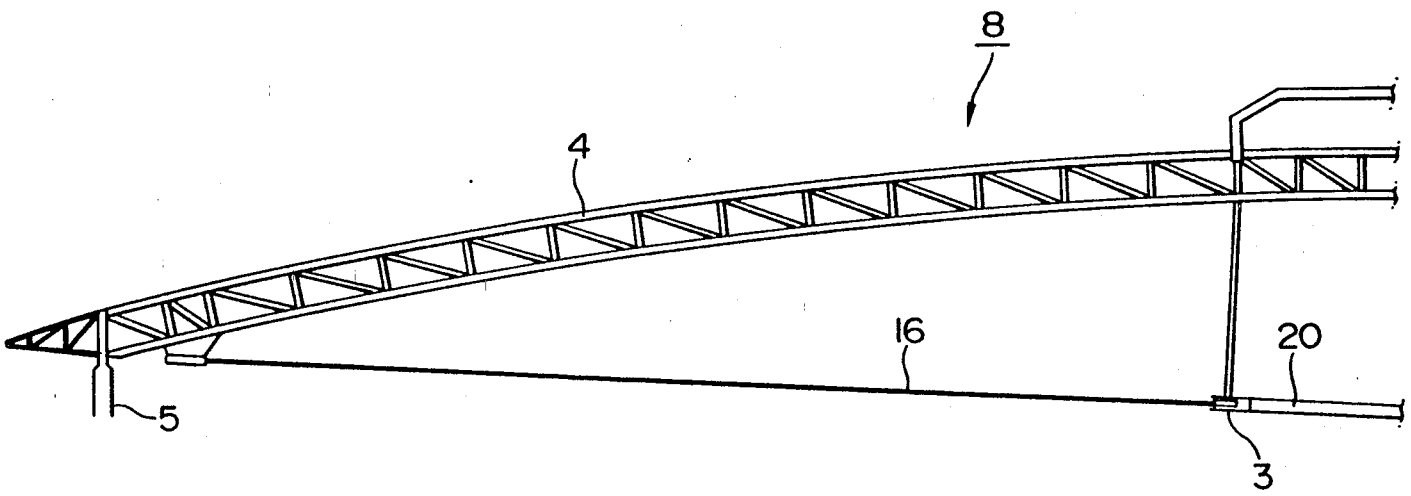
FIG. 1 is a sectional view of a chord truss roof according to an embodiment of the invention and shows an enlargement of a chord member and a connection member thereof.

Descriptions will now be given of embodiments of the invention with reference to the accompanying drawings.

In the following description, identical reference numerals denote corresponding or the same constituent elements as those of the roof described above with reference to FIGS. 5 to 9, and description on them will be omitted for brevity.

Figure 2:
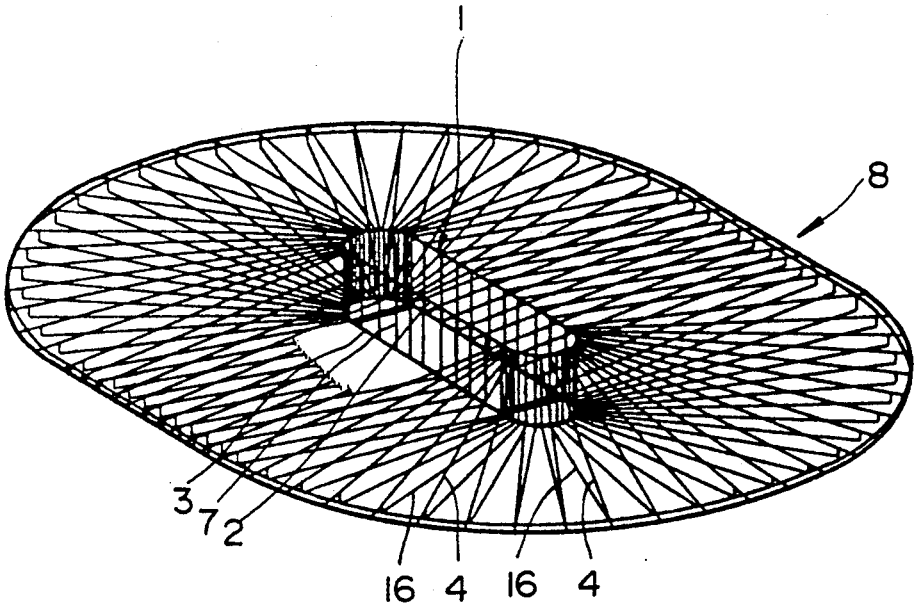
FIG. 2 is a schematic perspective view of the chord truss roof shown in FIG. 1.

FIG. 1 is a view showing a chord truss roof structure according to the first embodiment of the invention. As shown in FIG. 2, a ring-girder 1 of this embodiment is formed in an elliptical shape as viewed from above, and the roof 8 as a whole is also formed in an elliptical shape.

The roof of this embodiment is characterized in that each chord member, which has been one continuous element hitherto, is divided into two, with a tension ring 3 interposed therebetween and the thus divided chord members 16 are joined to the tension ring 3, respectively. Further, the ends of the divided chord members 16, which lie opposite one another at straight portions or girders of the tension ring 3 are connected to one another by connecting members 20 of H-section steel.

An arbitrary method may be used for connecting the chord members 16 to the tension ring 3. For instance, when the chord member 16 is made of a linear material such as a wire and so forth, the chord member 16 can be connected at its one end to the tension ring 3 by a bolt fastener 30 shown in FIG. 3, or the like.

According to this embodiment the length of each chord member 16 can be reduced to less than half in comparison with the case where a continuous chord member is used as is in the conventional roof structure. Therefore, the required stroke of a jack for tensioning each chord member 16 may be relatively short, and a large jack is unnecessary. Furthermore, when using the continuous chord members 6 as in the case of the conventional roof structure, saddle portions are provided on the tension ring 3 to allow the chord members 6 to bend and pass over the tension ring. In this case, there is a possibility that the friction at the saddle portions will unbalance the tension applied to each chord member on both sides of the tension ring 3. In contrast to this conventional roof structure, as the chord members 16 are divided on both sides of the tension ring 3, the above embodiment of the invention makes it possible to readily apply stress to the roof structure in a well-balanced manner by means of the chord members 16.

Moreover, in the described embodiment, the ends of the chord members 16 on the tension ring 3 side are connected to one another by the H-section steel members 20; in other words, the straight portions of the tension ring 3 are in a state of being connected to each other by the H-section steel members 20. Accordingly, even when the straight portions of the tension ring 3 are subjected to the forces for inwardly thrusting them due to the tensioning of the chord members 16, the H- section steel members 20 serve for reinforcement of the tension ring 3 and for allowing the forces acting on one of the straight portions to be smoothly transmitted to the other straight portion. As a result, the stress applied to the chord members 16 is smoothly and effectively transmitted to the tension ring 3, and a rational design of the roof structure becomes possible.

Figure 3:
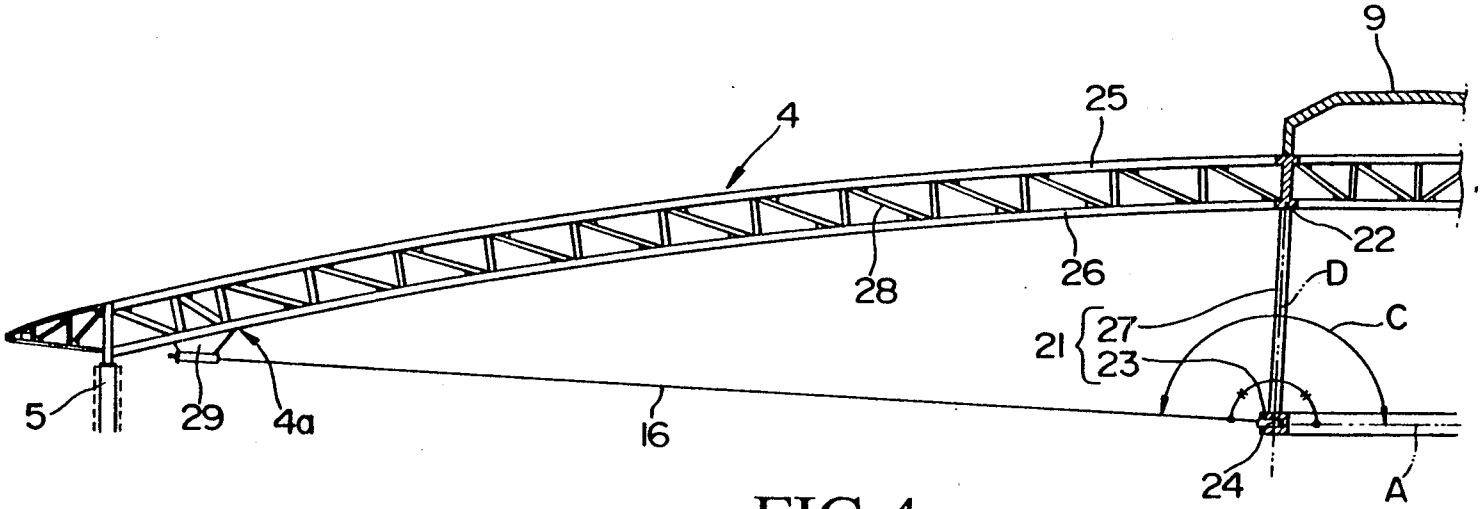
FIG. 3 is a sectional side view showing an essential portion of a chord truss roof structure according to another embodiment of the invention.

FIG. 3 shows an essential portion of a cross beam 4 of the chord truss roof structure according to another embodiment of the invention. The chord truss roof of the second embodiment is designed in view of another problem in the conventional chord truss roof.

Figure 5:
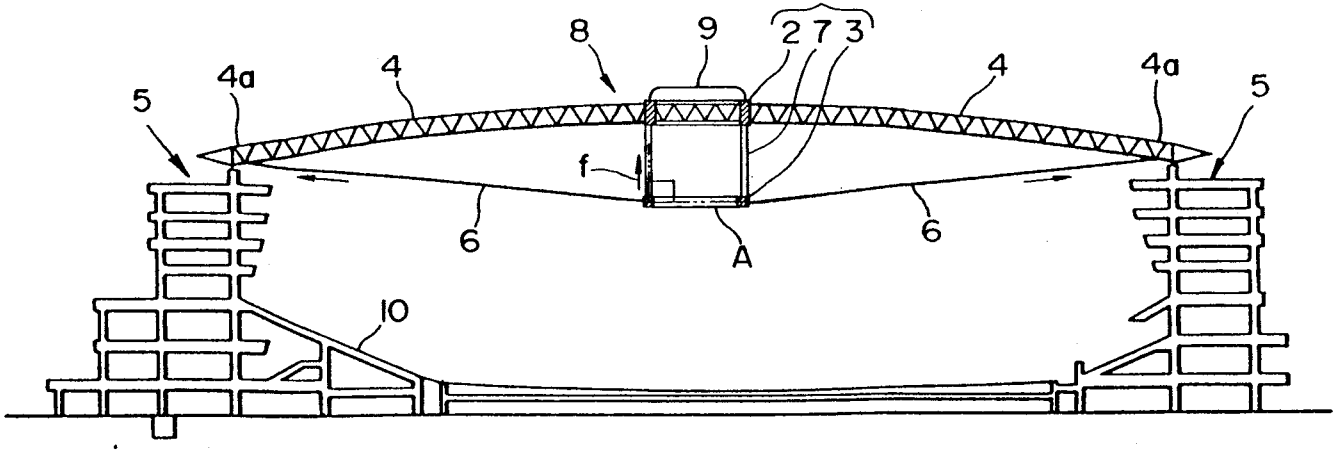
FIGS. 5 and 6 show a conventional chord truss roof structure.
Figure 6:
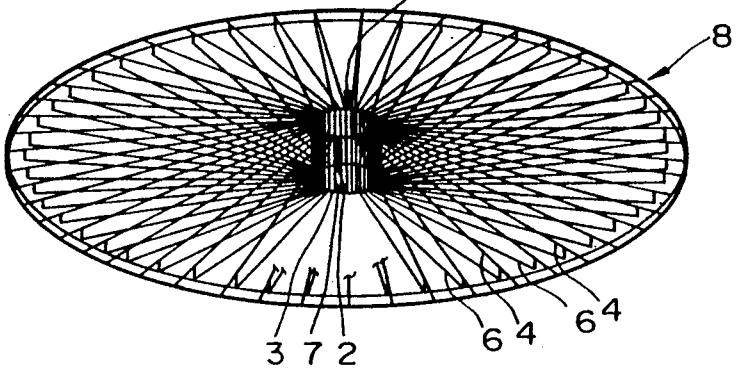
Figure 7:
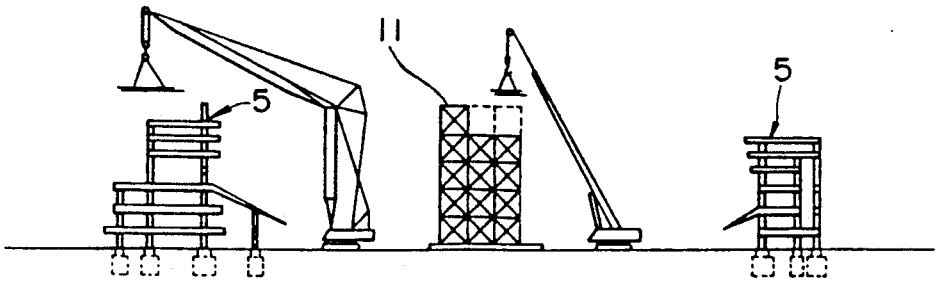
FIG. 7 is a schematic view showing a state of a working platform assembled when erecting a cross beam.
Figure 8:
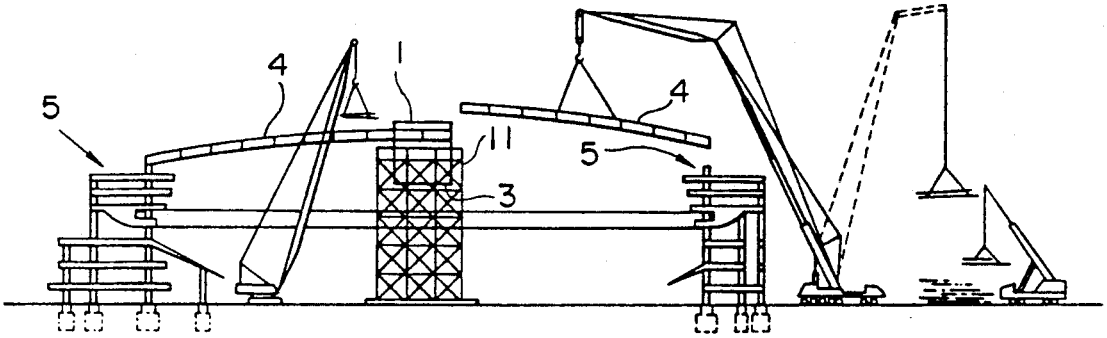
FIG. 8 is a schematic view showing a state of installation of a ring-girder and cross beams during the construction of the roof shown in FIG. 7.
Figure 9:
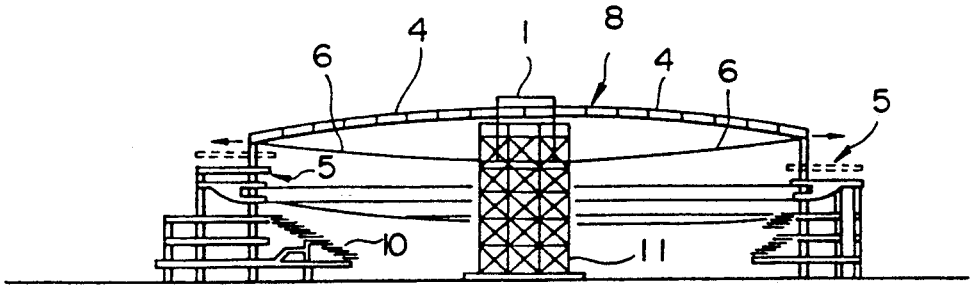
FIG. 9 is a schematic view showing a completed state of the roof shown in FIG. 7.

Namely, in the conventional chord truss roof structure, as shown in FIG. 5, each strut 7 of the ring-girder 1 is provided to stand vertically with respect to a plane A which is defined by the tension ring 3. This structure, however, requires a large tension to be applied to each chord member to allow the roof 8 to support itself, and is unsatisfactory in that the chord members are subjected to the large load.

The roof structure shown in FIG. 3 is in a state in which it is supporting itself. In the figure, reference numeral 21 generally denotes a ring-girder. The ring-girder 21, as in the ring-girder 1 of the first embodiment, is composed of a compression ring 22 and a tension ring 23 which are respectively located at upper and lower positions in the ring-girder and joined to each other by means of struts 27. The tension ring 23 of the ring-girder 21 of this embodiment, however, is formed slightly larger in size than the compression ring 22. Each strut 27 of the ring-girder 21 is provided along a segment D, of a line which bisects an angle C formed by a corresponding chord member 16 and the plane A. The plane A includes an imaginary ring which is defined by connecting joints 24 of the tension ring 23 and the respective chord members 16, and will be referred to in the following description as the plane in which the tension ring 23 is provided.

Around the compression ring 22 of the ring-girder 21, cross beams 4 are radially provided. Each cross beam 4 is a latticed beam structure which is composed of an upper chord member 25, a lower chord member 26 and lattice members 28. Adjacent cross beams 4 and 4 are joined to each other by means of braces 31 and beams 32, as shown somewhat diagramatically in FIG. 3A. One end of each chord member 16 is connected to a corresponding cross beam 4 at an outer end 4*a* thereof through a bracket 29. The other end of the chord member 16 is connected to the tension ring 23.

Figure 4:
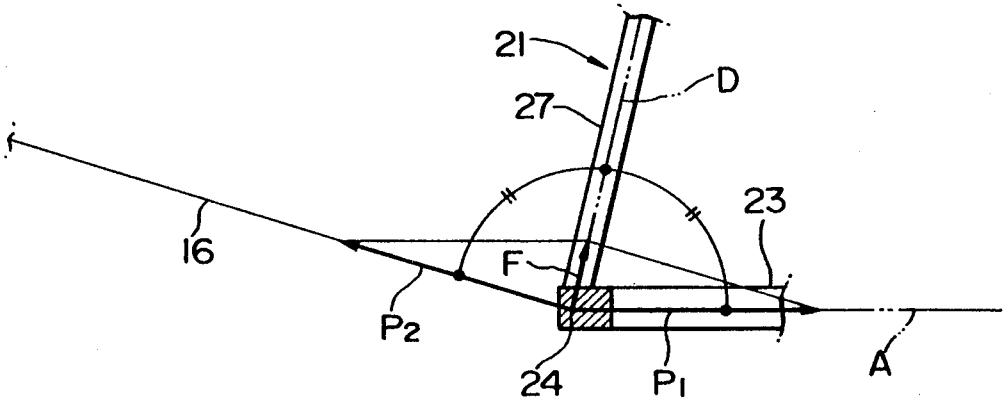
FIG. 4 is a view showing the direction of a force caused in the roof shown in FIG. 3 under a condition that chord members thereof are tensioned.

In the chord truss roof structure of this embodiment, each strut 27 of the ring-girder 21 is provided along the line segment D which bisects the angle C made by a corresponding chord member 16 and the plane A in which the tension ring 23 is provided. Therefore, as shown in FIG. 4, the direction of a resultant force F from the tensions P1 and P2 respectively acting on the tension ring 23 and the chord member 16 coincides with the direction in which the strut 27 is provided. For this reason, according to the chord truss roof structure, the tension applied to each chord member is effectively transmitted as the pushing up force F to a corresponding cross beam 4. With this chord truss roof structure, therefore, the tension to be applied to each chord member for letting the roof support itself can be reduced.

Moreover, in the chord truss roof structure of this embodiment, as described above, the direction of the resultant force F from the tensions P1 and P2 respectively acting on the tension ring 23 and each chord member 16 coincides with the direction in which a corresponding strut 27 is provided. This means that the load on the strut 27 acts in the axial direction thereof. According to this chord truss roof structure, therefore, no lateral load caused by the tension applied to each chord member acts on a corresponding strut 27, and the load on the strut 27 can be lessened.

Although the chord truss roof of the invention has been described on the basis of the specific forms of the embodiments, the details of the roof structure of the invention are not limited solely to the described embodiments, and various modifications may be made. For example, although the trussed roof has been described in the embodiments, to be formed in an arcuate shape as viewed from the side, it may also be formed as a gable roof. Further, the description of the first embodiment has been made so that the H-section steel members join the ends of the chord members to one another, which face one another at the straight portions of the tension ring 3. However, it is a matter of course that the H-section steel members 20 may be arranged obliquely, like braces, with respect to the straight portions of the tension ring. Furthermore, although these H-section steel members 20 are used as connection members in the above embodiment, other known members also may suitably be used to this end. Moreover, although in the embodiments the trussed roof has been described to be formed in an elliptical shape, the chord truss roof of the invention is applicable to any shape of roof, e.g., a rectangular shape, etc.

What is claimed is:

1. A chord truss roof structure for mounting on side wall sections comprising:

a ring-girder having a tension ring disposed approximately at the center of the chord truss roof, a compression ring located above the tension ring and in parallel thereto, and struts connected between the compression ring and the tension ring;

cross beams radially erected between the compression ring and said side wall sections, each cross beam having one side portion and another side portion, each one side portion being coupled to the compression ring and each other side portion being coupled to the side wall sections;

chord members, each having a first end and a second end, said chord members extending under tension, with said first ends being connected to said tension ring and said second end being connected to said another side portions, said first ends defining a plane through said tension ring;

connection members each connection member being connected between two end portions, said connection members being disposed in said plane, so that the chord members and the connection members therebetween form a unitary structure;

whereby the chord truss roof structure can be erected without a support base for supporting thereof.

2. The structure according to claim 1, wherein the cross beams are trussed girders.

3. The structure to claim 1, wherein each of said connection members is an H-beam.

4. The structure according to claim 1, wherein the struts bisect an angle between one of said chord members and one of said connection members in side view.

* * * * *